United States Patent [19]

Isert

[11] Patent Number: 5,022,821

[45] Date of Patent: Jun. 11, 1991

[54] VARIABLE PITCH FAN

[75] Inventor: Clarence A. Isert, Dewberry, Canada

[73] Assignee: Flexxaire Manufacturing Inc., Edmonton, Canada

[21] Appl. No.: 393,681

[22] Filed: Aug. 16, 1989

[51] Int. Cl.[5] ..... F04D 29/06

[52] U.S. Cl. ..... 416/167; 416/157 R; 416/163; 416/174

[58] Field of Search ..... 416/169 A, 174 R, 60, 416/167, 168, 169 R, 157 R, 146 A, 163, 164; 415/88

[56] References Cited

U.S. PATENT DOCUMENTS

| | | | |
|---|---|---|---|
| 1,368,808 | 2/1921 | Koenig | 416/169 A X |
| 1,384,672 | 7/1921 | Murray | 416/174 X |
| 1,491,589 | 4/1924 | Dzus | 416/163 |
| 1,541,557 | 6/1925 | Fuller | 416/163 |
| 1,635,315 | 7/1927 | Ehinger | 416/163 |
| 1,636,286 | 7/1927 | Christensen | 416/163 |
| 1,650,776 | 11/1927 | Stock | 416/163 |
| 1,712,883 | 5/1929 | Groner | 416/163 |
| 2,437,810 | 3/1948 | Earley et al. | 416/174 X |
| 2,812,027 | 11/1957 | Swan | 416/163 |
| 2,850,106 | 9/1958 | Swan | 416/167 |
| 2,885,013 | 5/1959 | Steiner | 416/163 |
| 3,301,330 | 1/1967 | Covert | 416/174 X |
| 3,967,916 | 7/1976 | Chitton | 416/167 |
| 4,046,486 | 9/1977 | Kolb | 416/174 X |
| 4,668,168 | 5/1987 | Schilder et al. | 416/174 X |

FOREIGN PATENT DOCUMENTS

| | | | |
|---|---|---|---|
| 1121775 | 4/1982 | Canada . | |
| 2504140 | 8/1975 | Fed. Rep. of Germany | 416/169 A |
| 576045 | 3/1946 | United Kingdom | 416/163 |

OTHER PUBLICATIONS

Introducing the Varofoil.

*Primary Examiner*—Robert E. Garrett
*Assistant Examiner*—John T. Kwon
*Attorney, Agent, or Firm*—Anthony R. Lambert

[57] ABSTRACT

A fan assembly has variable pitch blades adjustable from outside the assembly while the fan is operating so as to alter the volume and direction of the induced airflow. The fan blades have an airfoil configuration such that air is moved by a fan in either direction with equal efficiency. The fan assembly includes a non-rotating secondary shaft axially moveable in a main shaft. The secondary shaft has a spider interconnected with the crank arms of the blade arms by a snugly fitted universal joint assembly. The airfoil configuration of the blades is neutral and the blades are straight. The fan assembly is lubricated by a pick-up non-rotatably mounted in a reservoir formed by the pulley hub and blade hub. The pick-up feeds lubrication directly to the bearing assemblies on which the spider and pulley hub are mounted.

8 Claims, 3 Drawing Sheets

VARIABLE PITCH FAN

FIELD OF THE INVENTION

This invention relates to fans and in particular to a multi-bladed propeller type fan adjustable to reverse the flow of air or other fluids or gases in which the fan operates.

BACKGROUND OF THE INVENTION

There are numerous fan installations in industry where the fan is required to move air in one direction and then, after a period of time, to move the air in the opposite direction. It is also desirable that a fan be adjusted to move a smaller amount of air without changing the speed of the fan. For example, on the engine of a tracked type of tractor such as a bulldozer or the like it is desirable to have the fan in a neutral or zero pitch position when the engine of the vehicle is being warmed up. When the equipment is being used in the summer, however, it is preferred to have air blown through the radiator and away from the operator but just the reverse is desired in the colder winter months when it is preferred to have the warm air of the radiator blown towards the operator.

A further example is when such equipment is used in dusty and dirty conditions resulting in radiators being partially plugged or blocked with debris from the environment. It is desirable at such times that the fan be reversed in order to blow out the dust, dirt or other materials from the interstices of the radiator core.

Systems presently available require that the engine fan be stopped so that the blades can be manually adjusted one at a time to set the required pitch, by the operator.

Another example is in the mining industry where, in a mine shaft, fans are used to move air down a shaft and then, after a time, the motors are reversed and the air is exhausted from the mine. These are large diameter fans and require large motors of substantial horsepower. The stopping, starting and reversing of these motors is time consuming and expensive.

In large agricultural operations it is required to keep the air in buildings at a constant temperature during changing outside air temperature levels. A variable speed reversing fan which is temperature controlled is expensive when compared to a constant speed fan with variable pitch blades.

There are fans on the market which are reversible but they do not move air in both directions with equal efficiency. There are also some designs which disclose adjustable blades but they are limited in the number of blades and have inherent friction and lubrication problems associated with the inner components of the fan assemblies. Such fans have never come into production due to these problems. There is also the problem of the physical size associated with the available adjustable blade fans which prohibits their use in many vehicular applications.

SUMMARY OF THE INVENTION

The present invention overcomes many of the above mentioned problems associated with conventional fan assemblies. The present invention allows an engine or electric motor to continue running in one direction while the blade pitch can be reversed gradually to completely change the direction of the air flow. In the example of the large agricultural operations mentioned above, the present invention provides a constant speed, variable pitch fan controlled by a temperature sensing system.

According to a broad aspect, the invention relates to a fan assembly incorporating a plurality of variable pitch blades adjustable during operation of said assembly to alter volume and direction of air flow induced by said assembly, comprising:

a main, non-rotatable shaft;

a second shaft coaxially located within said main shaft for limited axial fore and aft movement within said main shaft;

a pulley hub and pulley mounted for rotation on said main shaft;

a blade hub secured to said pulley hub for rotation therewith;

a plurality of fan blades each having a blade shaft mounted for rotation in said blade hub;

each blade shaft having an interior end extending into the blade hub, and having a crank arm secured to the interior end;

means for axially moving the secondary shaft within the main shaft;

a spider rotatably mounted on the secondary shaft, the spider including a plurality of spherical bearings, one spherical bearing corresponding to each blade shaft;

the crank arm of each blade shaft being snugly mounted for rotation within the spherical bearing corresponding to that blade shaft;

one or both of the pulley hub and hub defining an annular reservoir for receiving lubricant upon rotation of the fan assembly;

the pulley hub being mounted on a first bearing assembly on the main shaft;

the spider being mounted on a second bearing assembly on the secondary on the secondary shaft;

a stationary feed pipe fixed to the main shaft and having a pick-up end disposed within the reservoir;

the secondary shaft including a lubricant gallery terminating at openings in fluid connection with the first and second bearing assemblies; and the lubricant gallery directly interconnecting the feed pipe and the openings.

BRIEF DESCRIPTION OF THE DRAWINGS

The invention is illustrated by way of example in the accompanying drawings in which.

DETAILED DESCRIPTION OF THE PREFERRED EMBODIMENT

The fan assembly is driven by any suitable means such as an electric motor, gasoline or diesel engine, lay shaft or the like, and such drive means to the fan pulley is not illustrated. Moreover, it is to be appreciated that different numbers of blades may be used in the configuration to be described and that the airfoil shape of the blades may vary.

Figure 1:
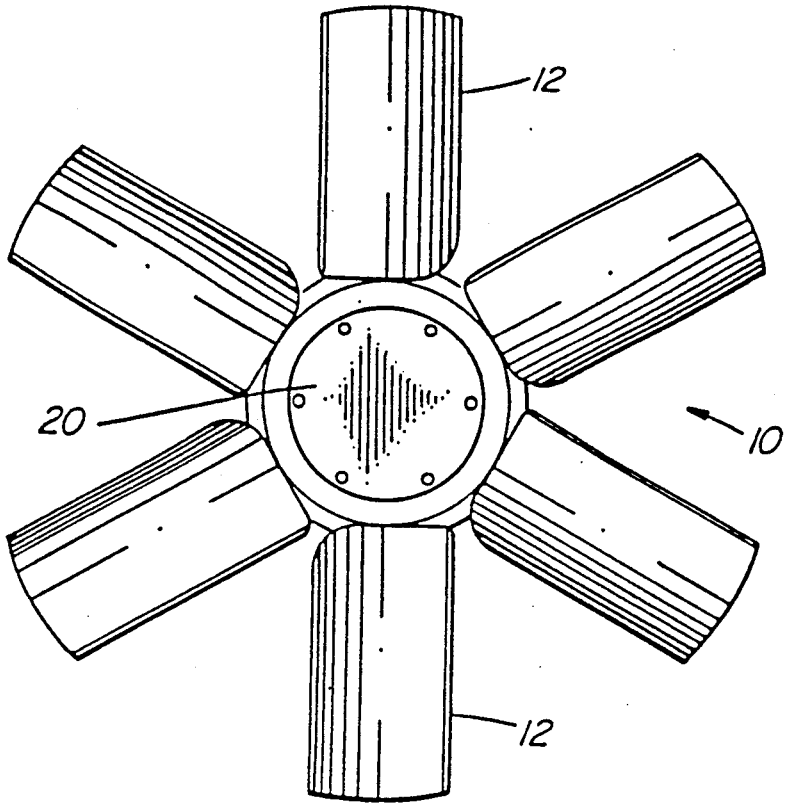
FIG. 1 is a frontal view of a six bladed version of the present invention.
Figure 2:
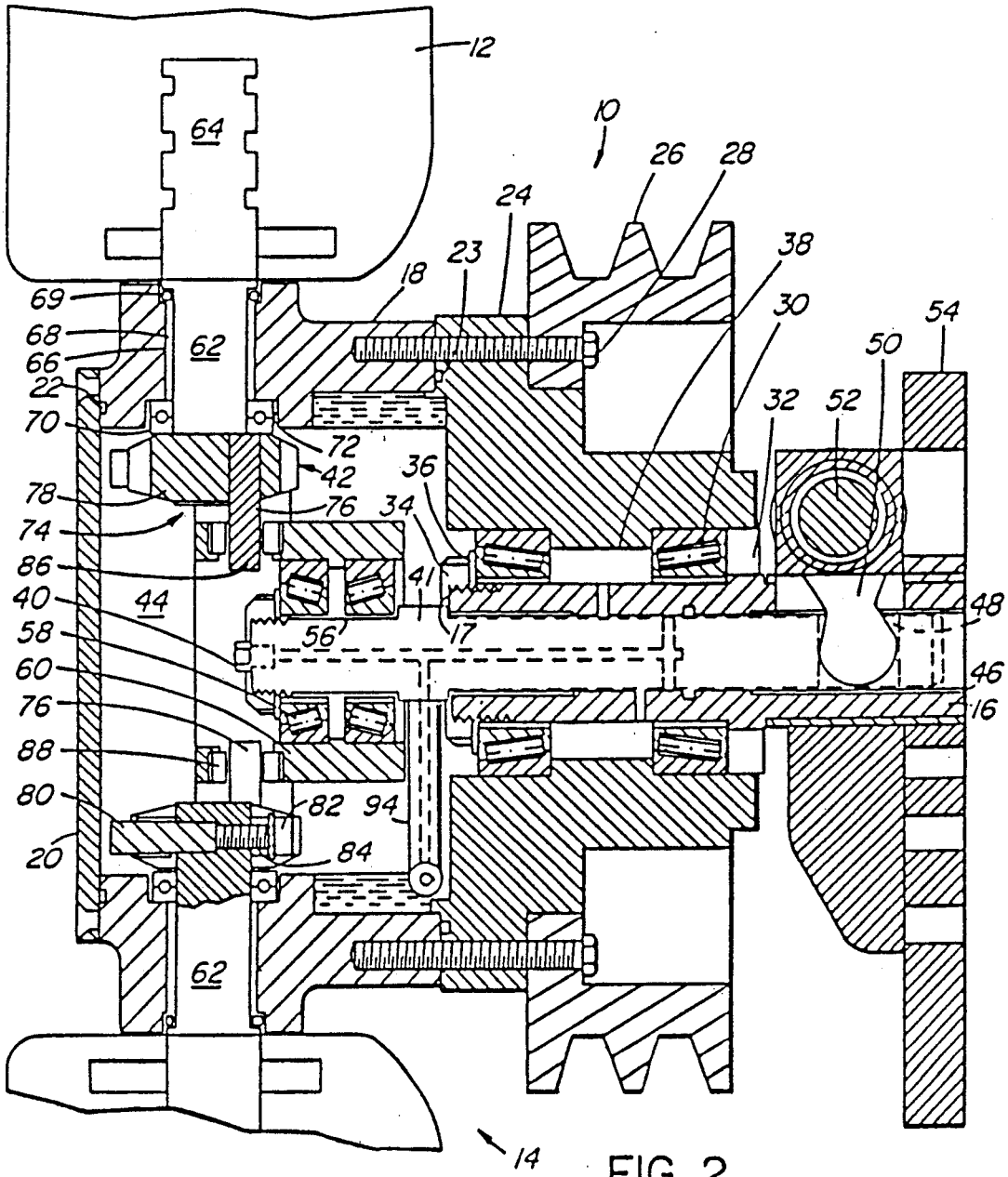
FIG. 2 is a side elevation in cross-section of the fan assembly according to the present invention showing the relative position of the internal parts of the assembly with the blades of the assembly in a forward pitch position.

Referring to FIGS. 1 and 2, the fan assembly indicated generally at 10 externally discloses a plurality of blades 12 mounted in an assembly housing 14 rotatably mounted on a main shaft 16. Housing 14 comprises a blade hub 18 having a front cover 20 and sealed thereto by means of an oil ring seal 22. A pulley hub 24 and pulley 26 are secured to the blade hub 18 by means of a series of circumferentially positioned bolts 28.

Figure 3:
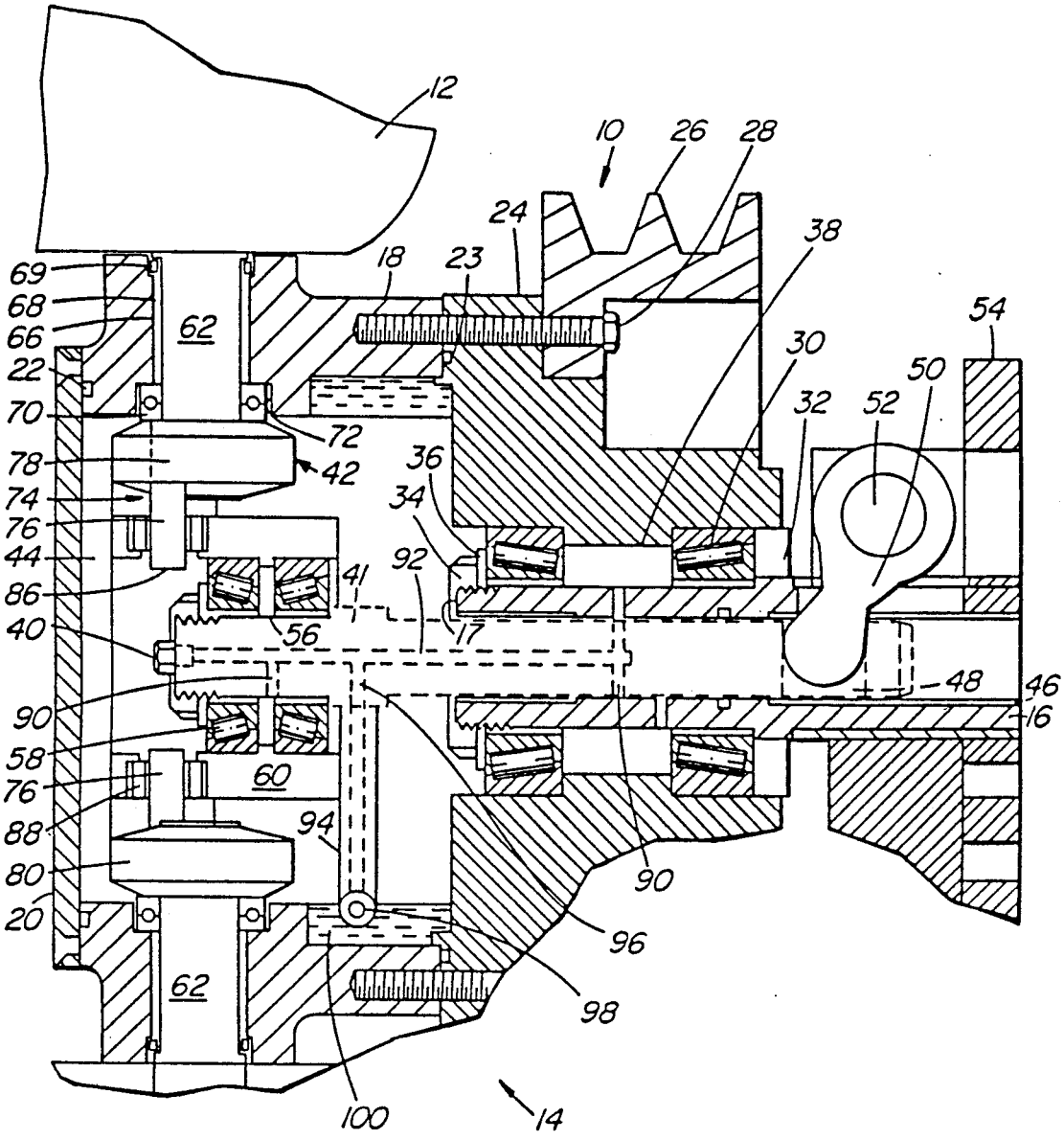
FIG. 3 is a view similar to FIG. 2 but shows the relative position of the internal parts of the assembly with the blades in a reverse pitch position.

As clearly seen in FIGS. 2 and 3, the pulley hub is rotatably mounted to the main shaft 16 by means of a pair of spaced bearing races 30 which include a suitable oil seal 32 adjacent to one race and the other race securing the pulley hub 24 in place by means of a locknut 34 and washer 36. As illustrated, pulley hub 24 includes an inner peripheral shoulder 38 of reduced diameter which lies between the two bearing races 30 and is thereby axially located on the main shaft 16.

Pulley 26 is shown as a separate component from pulley hub 24 and this is the preferred arrangement although a unit structure of these two components is feasible.

The means for reversing the pitch of the fan blades 12 includes a secondary shaft 40 which is interconnected to blade reversing means illustrated generally at 42 and located within the cavity 44 of the fan assembly.

Secondary shaft 40, like main shaft 16, is a nonrotating element of the assembly and is concentrically located within the main shaft 16 and mounted for reciprocating, axial movement with respect to the main shaft from the back position shown on FIG. 2 to the forward position shown on FIG. 3. Shaft 40 is slidably positioned in shaft 16 by way of suitable bushings 46 and that portion of shaft 40 that lies outside the rotatable assembly 10 is provided with a slot or like opening 48 which receives an actuating pin or crank 50 mounted on a shaft 52 which in turn is located on a bracket or mounting plate 54 which is used to secure the assembly to a desired location on the vehicle.

It will be appreciated that the means for actuating the crank or pin 50 to reciprocate the secondary shaft 40 within the main shaft 16 can be a manual operation, or a hydraulic or electric operation possibly governed by temperature sensing means.

The end of the secondary shaft 40 remote from the crank 50 has a portion 56 of reduced diameter on which a pair of bearing races 58 are located and which support a spider 60 mounted for rotation thereon.

As shown in FIGS. 2 and 3, each fan blade 12 has a shaft 62 the upper end of which 64 is secured to the fan blade while the lower end of the shaft 62 is located in a cylindrical aperture 66 in the hub 18 by means of a bushing 68. An oil seal 69 mounts the outer end of the end of the shaft 62 in the bushing 68 and the inner end of the shaft 62 is supported by a bearing 70 located in a raceway 72 at the inner end of aperture 66.

A bellcrank 74 interconnects the inner end of each blade shaft 62 to the spider 60 and this is accomplished by means of an offset crank pin 76 mounted in an arm 78 by means of a tapered locking pin 80 secured in place by a suitable nut and washer combination 82 and 84 which secure the crank arm 78 to the inner end of the blade shaft 62.

The crank pin 76 includes an inner end 86 which is located in the spider 60 by means of spherical or roller bearings 88, one for each crank pin 76.

Figure 5:
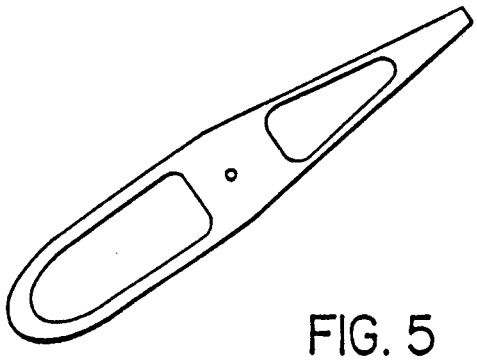
FIG. 5 is a cross-section of a typical neutral airfoil shape of the blade of the fan assembly.

As shown by the cross-section of the blade 12 in FIG. 5 its configuration provides an equal surface to the air whether it is oriented for forward or rearward attack against the air as shown between FIGS. 2 and 3.

As shown in FIG. 1, each fan blade is straight, that is, it is not twisted, and thus provides an equal surface to the air no matter whether oriented for rearward or forward attack.

FIG. 2 shows the crank pin 50 being so located in the slot 48 of secondary shaft 40 that the shaft 40 is located at its innermost position in the main shaft 16 and a peripheral flange 41 on the shaft 40 engages the terminal end 17 of main shaft 16 to limit the innermost movement of one shaft within the other.

Actuating the crank pin 50 to vary the pitch of the fan blades results in the change of location of the elements shown in FIG. 3. It will be observed that the secondary shaft 40 has moved to the left in FIG. 3 by virtue of the crank pin 50 operating in the slot 48 of the shaft and, in so doing, the spider 60, operating on the crank pins 76 of the bellcranks 74 rotate the blade shafts 62 and therefore the fan blades 12 to their illustrated position, a reverse pitch compared to that of FIG. 2.

The secondary shaft 40 also incorporates the lubrication system of the present invention.

Figure 4:
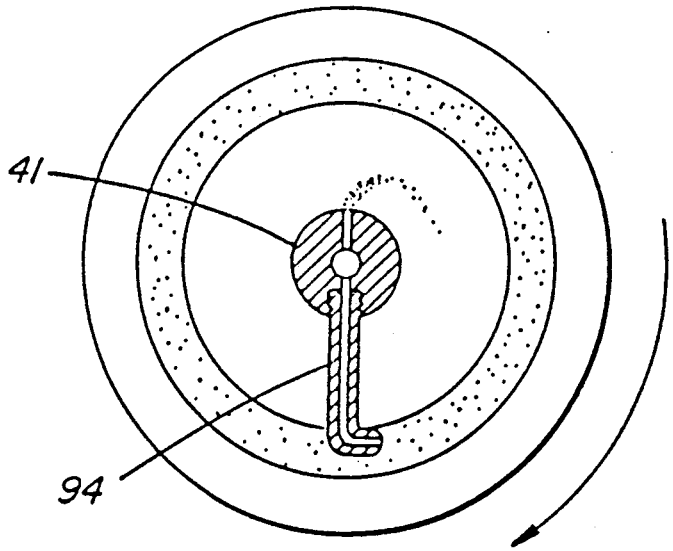
FIG. 4 is a schematic view, partly in cross-section, illustrating the lubrication system of the invention.

It will be noted from FIGS. 2 and 3 that an oil ring seal 23 is located between the mating surfaces of the pulley hub 24 and blade hub 18 as well as between the cover 20 and the blade hub 18. These oil ring seals, together with the oil seal 32 provide a sealed cavity 44 in which oil can be distributed and circulated. To this end, secondary shaft 40 includes a plurality of oil galleries 90 adapted to direct oil to the bushings and bearings of the assembly. The galleries 90 are interconnected to the central gallery 92 which in turn is interconnected to a feed pipe 94 and is in communication therewith through a short gallery 96. As seen in FIG. 4 as well as in FIGS. 2 and 3, the lower end of the feed pipe has a pickup end 98 which sits in a trough 100 that provides a reservoir for lubricating oil, the level thereof shown being that when the assembly is running.

When the fan assembly is being rotated, centrifugal force throws the lubricating oil into the trough 100 and the pickup end 98 of the feed pipe 94 receives the oil under the pressure induced by the rotation of the assembly, that pressure working through the galleries 96, 92 and 90 to lubricate the bearing races and bushings between the stationary and rotatable parts of the assembly. The lubricant works through the bearings and splashes onto the remainder of the moving parts before being again directed to the reservoir portion of the cavity.

While the present invention has been described in connection with a specific embodiment thereof and in a specific use, various modifications of the invention will occur to those skilled in the art without departing from the spirit and scope of the invention as set forth in the attached claims.

The terms and expressions which have been employed in this specification are used as terms of description and not of limitation and there is no intention in the use of such terms and expressions to exclude any equivalents of the features shown and described or portions thereof. It is recognised that various modifications are possible within the scope of the invention as claimed.

I claim:

1. A fan assembly incorporating a plurality of variable pitch blades adjustable during operation of said assembly to alter volume and direction of airflow induced by said assembly, comprising:

a main, non-rotatable shaft;

a second shaft coaxially located within said main shaft for limited axial fore and aft movement within said main shaft;

a pulley hub and pulley mounted for rotation on said main shaft;

a blade hub secured to said pulley hub for rotation therewith;

a plurality of fan blades each having a blade shaft mounted for rotation in said blade hub;

each blade shaft having an interior end extending into the blade hub and having a crank arm secured to the interior end;

means for axially moving the secondary shaft within the main shaft;

a spider rotatably mounted on the secondary shaft, the spider including a plurality of spherical bearings, one spherical bearing corresponding to each blade shaft;

the crank arm of each blade shaft being snugly mounted for rotation within the spherical bearing corresponding to that blade shaft;

one or both of the pulley hub and hub defining an annular reservoir for receiving lubricant upon rotation of the fan assembly;

the pulley hub being mounted on a first bearing assembly on the main shaft;

the spider being mounted on a second bearing assembly on the secondary shaft;

a stationary feed pipe fixed to the main shaft and having a pick-up end disposed within the reservoir;

the secondary shaft including a lubricant gallery terminating at openings in fluid connection with the first and second bearing assemblies; and the lubricant gallery directly interconnecting the feed pipe and the openings.

2. The fan assembly of claim 1 in which the spider is mounted on a bearing assembly on the secondary shaft, the spider extends forwardly of the bearing assembly, and the spherical bearing is secured to a forward end of the spider.

3. The fan assembly of claim 2 further including a mounting bracket, the means for axially moving the secondary shaft being mounted on the main shaft between the mounting bracket and the pulley hub.

4. The fan assembly of claim 1 in which each fan blade is straight and has a neutral airfoil shape in cross-section extending along the fan blade.

5. The fan assembly of claim 4 further including a mounting bracket, the means for axially moving the secondary shaft being mounted on the main shaft between the mounting bracket and the pulley hub.

6. The fan assembly of claim 1 further including a mounting bracket, the means for axially moving the secondary shaft being mounted on the main shaft between the mounting bracket and the pulley hub.

7. A fan assembly incorporating a plurality of variable pitch blades adjustable during operation of said assembly to alter volume and direction of air flow induced by said assembly, comprising:

a main, non-rotatable shaft;

a second shaft coaxially located within said main shaft for limited axial fore and aft movement within said main shaft;

a pulley hub and pulley mounted for rotation on said main shaft;

a blade hub secured to said pulley hub for rotation therewith;

a plurality of fan blades each having a blade shaft mounted for rotation in said blade hub;

each blade shaft having an interior end extending into the blade hub, and having a crank arm secured to the interior end;

means for axially moving the secondary shaft within the main shaft;

a spider rotatably mounted on the secondary shaft, the spider including a plurality of universal joint assemblies, one universal joint assembly corresponding to each blade shaft;

the crank arm of each blade shaft being snugly mounted for rotation within the universal joint assembly corresponding to that blade shaft;

one or both of the pulley hub and hub defining an annular reservoir for receiving lubricant upon rotation of the fan assembly;

the pulley hub being mounted on a first bearing assembly on the main shaft;

the spider being mounted on a second bearing assembly on the secondary shaft;

a stationary feed pipe fixed to the main shaft and having a pick-up end disposed within the reservoir;

the secondary shaft including a lubricant gallery terminating at openings in fluid connection with the first and second bearing assemblies; and the lubricant gallery directly interconnecting the feed pipe and the openings.

8. The fan assembly of claim 7 in which the feed pipe is connected to the lubricant gallery approximately midway between the first and second bearing assemblies.

* * * * *